United States Patent [19]

Fujita et al.

[11] 4,436,559

[45] Mar. 13, 1984

[54] PROCESS FOR MANUFACTURING BORIDE DISPERSION COPPER ALLOYS

[75] Inventors: Hironori Fujita; Tohru Arai, both of Aichi, Japan

[73] Assignee: Kabushiki Kaisha Toyota Chuo Kenkyusho, Japan

[21] Appl. No.: 387,453

[22] Filed: Jun. 11, 1982

[30] Foreign Application Priority Data

Jun. 12, 1981 [JP] Japan ..... 56-91096

[51] Int. Cl.[3] ..... C23F 7/00

[52] U.S. Cl. ..... 148/6; 148/6.11; 204/37 R; 204/49; 427/431

[58] Field of Search ..... 148/6.11, 6.31, 6; 204/37 R, 49; 427/431

[56] References Cited

U.S. PATENT DOCUMENTS 2,196,002 4/1940 Whitney et al. ..... 204/37 R 2,955,959 10/1960 Du Rose ..... 204/37 R 3,352,667 11/1967 Das et al. ..... 148/6 B 3,634,145 1/1972 Homan ..... 148/6.11

4,011,107 3/1977 Hayes ..... 148/6 B

*Primary Examiner*—Michael R. Lusignan

*Assistant Examiner*—Janyce A. Bell

*Attorney, Agent, or Firm*—Berman, Aisenberg & Platt

[57] ABSTRACT

A process for manufacturing a boride dispersion copper alloy by preparing a metallic material having a surface portion comprising at least one of beryllium, gallium, manganese, nickel, palladium, silicon and vanadium, and copper or an alloy thereof, and diffusing boron into the surface portion. The resulting material includes fine boride particles uniformly dispersed in the surface portion and is useful as a material for electrical contacts or sliding parts due to its high resistance to adhesion, wear and arc, and excellent electrical conductivity and sliding properties.

16 Claims, 4 Drawing Figures

PROCESS FOR MANUFACTURING BORIDE DISPERSION COPPER ALLOYS

BACKGROUND OF THE INVENTION

1. Field of the Invention

This invention relates to a process for manufacturing boride dispersion copper alloys which are used for making electrical contacts, sliding parts, and the like.

2. Description of the Prior Art

A composite of a boride and copper has hitherto been manufactured by sintering a mixture of their powders, since boron does not form a solid solution with copper.

SUMMARY OF THE INVENTION

According to this invention, which is completely different from the conventional process, an alloy is formed from a metal constituting a boride and copper, and boron is diffused in the surface of the alloy to form a layer of fine boride particles dispersed in a portion of the alloy near its surface.

It is an object of this invention to provide a novel alloy which is superior in electrical conductivity and sliding properties.

It is another object of this invention to provide an alloy having high resistance to adhesion, wear and arc.

The process of this invention for manufacturing a boride dispersion copper alloy essentially comprises the steps of preparing a metallic material having a surface portion (preferably of a depth of 0.01 to 1 mm from the surface) containing at least one of beryllium, gallium, manganese, nickel, palladium, silicon and vanadium (preferably in the amount of 5 to 75 atom %), and copper or an alloy thereof, and diffusing boron in the surface portion of the metallic material to form therein fine particles of at least one boride of beryllium, gallium, manganese, nickel, palladium, silicon or vanadium. (Throughout this specification, % means atom % unless otherwise noted.)

According to the process of this invention, there is obtained a boride dispersion copper alloy of which only a surface portion contains a boride having an average particle diameter of 0.1 to 20 microns, and dispersed in copper or an alloy thereof.

The boride dispersion copper alloy is superior in electrical conductivity and sliding properties, since it has a metallic matrix, and its surface portion has a copper or copper alloy matrix. It is highly resistant to adhesion and wear, since fine boride particles are dispersed in its surface portion. Therefore, the boride dispersion copper alloy obtained by the process of this invention is suitable for making electrical contacts, or sliding parts.

DETAILED DESCRIPTION OF THE INVENTION

Figure 1:
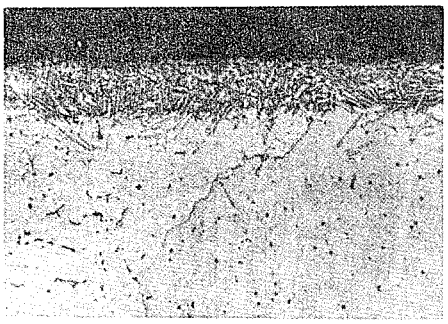
FIGS. 1 to 4 are microphotographs showing the cross sections of the boride dispersion copper alloys manufactured in accordance with Embodiments 2, 3, 4 and 7, respectively, of this invention.

The process of this invention employs a metallic material having a surface portion (preferably of a depth of 0.01 to 1 mm and most preferably 0.03 to 0.2 mm) comprising a copper alloy containing at least one of beryllium, gallium, manganese, nickel, palladium, silicon and vanadium (preferably in the amount of 5 to 75 %), and copper or an alloy thereof. It is important to have a boride formed only in its surface portion. The rest of the material does not participate directly in the formation of a boride, but may be composed of any metal depending on the purpose for which the alloy of this invention is used.

At least one of beryllium, gallium, manganese, nickel, palladium, silicon and vanadium is employed to form the surface portion, since any of these metals can form a copper alloy containing several or more percent of any such metal, and combine with boron to form a boride. The boride thereby formed has a relatively high degree of hardness, a low degree of resistivity and a high melting point which are required of electrical contacts and sliding parts. For example, nickel boride ($Ni_2B$) has a hardness of Hv 1,500 to 2,500, and vanadium boride ($VB_2$) has a hardness of Hv 2,500 to 3,000. They have a resistivity of $14\times10^{-6}$ $\Omega cm^{-1}$ and $16\times10^{-6}$ $\Omega cm^{-1}$, respectively. Their melting points are as high as at least 1,230° C. and 2,100° C., respectively. The boride of any metal hereinabove listed has a hardness of at least Hv 1,500, a resistivity of 10 to $100\times10^{-6}$ $\Omega cm^{-1}$, and a melting point of 1,000° C. to 2,500° C.

The diffusion of boron is likely to form a uniform boride layer instead of a layer in which fine boride particles are dispersed, depending on the composition of the copper alloy in the surface portion of the metallic material. In such a case, it is advisable to reduce the amount of the boride forming metal in the copper alloy, or incorporate another element into the copper matrix to form a layer in which a boride is uniformly dispersed. In order to form nickel boride, for example, it is advisable for the surface portion of the metallic material to comprise a nickel-copper alloy containing 5 to 75% of nickel, the balance being copper. An increase in the amount of nickel is, however, likely to result in difficulty in the formation of nickel boride particles, or segregation of nickel boride along the crystal boundary of the nickel-copper alloy. In such a case, it is effective to incorporate at least one of manganese, titanium, silicon and chromium into the nickel-copper alloy in order to promote formation of fine nickel boride particles, and prevent the segregation of nickel boride. The preferred quantity of any such metal incorporated into the nickel-copper alloy is in the range of, say, 0.1 to 3%.

The metallic material may be composed of a copper alloy as a whole, including its surface portion. For this purpose, a mixture of metals is melted to form an alloy.

A metallic material of which only the surface portion is composed of a copper alloy can typically be prepared by coating beryllium, gallium, nickel or the like on the surface of a copper matrix, and heating the coated metal to diffuse it into copper. Beryllium or the like may be coated on the copper surface by a known method, such as electroplating, chemical plating, vacuum deposition, sputtering or spray coating. The diffusion of beryllium, etc. into the matrix is accomplished by the thermal diffusion of the metal at a high temperature. Manganese, titanium, silicon, chromium, or like metal employed to form fine particles of boride can be incorporated into copper beforehand, or can alternatively be applied and diffused when diffusing beryllium, or the like.

The metallic material may be in the form of a sheet, rod or cottony mass, or of any other form that suits the purpose for which the product of this invention will be used.

A known boriding method can be employed to diffuse boron in the surface of the metallic material to form a layer of fine boride particles dispersed in its surface portion. Typical examples of the boriding method include a molten salt method which comprises immersing the metallic material in a molten bath containing dissolved boron, a powder method which comprises burying the metallic material in a mixed powder of, for example, boron carbide, and boron fluoride or ammonium chloride, and heating it, and a physical vapor deposition method which comprises evaporating boron on the metallic material in a vacuum. The boron diffused in the metallic material combines with beryllium or the like in the copper alloy to form a boride. The boride thereby obtained is beryllium boride ($Be_2B$ or $BeB_2$), gallium boride ($GaB_{12}$), manganese boride (MnB or $MnB_2$), nickel boride ($Ni_2B$ or $Ni_3B$), palladium boride ($Pd_3B_2$), silicon boride (SiB), or vanadium boride (VB or $VB_2$), or a mixture thereof. A layer in which boride particles are uniformly dispersed in copper or an alloy thereof is, thus, formed. The smaller the boride particles, the better. According to the process of this invention, it is possible to obtain a boride having a particle diamater of, say, 0.1 to 10 microns. It is preferable for the boride particles to occupy about 5 to 80% by volume of the surface portion. The preferred thickness of the boride layer in the surface portion is in the range of 0.01 to 1.0 mm (most preferably 0.03 to 0.2 mm). A layer having a greater thickness can be formed if the diffusion of boron is continued for a longer time, or if the heating temperature is raised.

The invention will now be described with reference to several embodiments thereof.

EMBODIMENT 1

Ninety parts by weight of copper and 10 parts by weight of nickel were melted to form a nickel-copper alloy consisting of 89.3% of copper and 10.7% of nickel. Prepared from this copper alloy were two kinds of specimens, i.e., a circular specimen having a diameter of 6.4 mm and a thickness of 2.4 mm, and a 50 mm square specimen having a thickness of 1 mm.

These specimens were immersed in a molten salt bath composed of 60 parts by weight of borax, and 40 parts by weight of boron carbide ($B_4C$) powder having a particle diameter of 79 to 149 microns, and having a temperature of 900° C., and removed therefrom after four hours, whereby a boride dispersion copper alloy was obtained.

Examination of the cross sections of the specimens by a microscope indicated the presence of a surface portion having a thickness of about 0.08 mm in the boride dispersion copper alloy. The surface portion was found to contain about 12% by volume of nickel boride having a particle diameter of 1 to 5 microns.

The boride dispersion copper alloy was tested for suitability as a material for making switching contacts, and sliding contacts. The circular specimen was employed for the former test, and the square specimen for the latter test.

An ASTM tester was used for the former test, and two circular specimens were brought into contact with each other, and separated from each other 250,000 times repeatedly at a DC voltage of 12±0.1 V, a current of 10 A, a lamp load of 130 W, a contact load of 300 g, a separation load of 300 g, and a repetition rate of 60 times per minute.

The test showed acceptable results. There was an average contact resistance of 0.8 mΩ. No adhesion, or other problem was observed, though slight oxidation was found on the contact surfaces.

The sliding contact test was conducted by a specially prepared tester including a tough pitch copper plate rotating at a speed of 60 rpm, and having a point 12.5 mm spaced apart from its axis of rotation against which a semispherical specimen was to be pressed. The test was conducted at a DC voltage of 12±1 V, a current of 10 A, a contact load of 300 g and a sliding rate of 78.5 mm per second for a total sliding distance of 62,000 m without using any lubricant. The square specimen was formed with a central semispherical projection having a radius of 5 mm, and defining a sliding surface.

The test results were acceptable with a contact resistance of about 1.2 mΩ, though slight wear was observed, and confirmed the usefulness of the alloy as a material for making sliding contacts.

A similar sliding contact test was conducted on tough pitch copper known as a material for making contacts and sliding parts. The test showed a contact resistance of 2.0 to 5.0 mΩ, a heavy wear, and heavy oxidation on the contact surfaces.

The test results confirmed the superiority of the boride dispersion copper alloy to tough pitch copper as a material for making sliding contacts.

EMBODIMENT 2

Fifty parts by weight of copper and 50 parts by weight of nickel were melted to form a nickel-copper alloy consisting of 48.0% of copper and 52.0% of nickel. Prepared from this nickel-copper alloy were two kinds of specimens having the same shapes as those prepared in EMBODIMENT 1. A boride dispersion copper alloy was prepared by treating the specimens in a molten salt bath as in EMBODIMENT 1.

FIG. 1 is a microphotograph showing a cross section of the alloy obtained. As is obvious from FIG. 1, the alloy had a surface portion having a thickness of 0.08 mm, and containing about 60% by volume of nickel boride having a particle diameter of 2 to 40 microns.

The tests conducted in EMBODIMENT 1 were repeated for the alloys obtained. The test results were all satisfactory with a contact resistance of 0.8 mΩ on switching contacts, and 1.0 mΩ on sliding contacts. The results did not indicate any appreciable wear, nor anything wrong in any other respect.

EMBODIMENT 3

Figure 2:
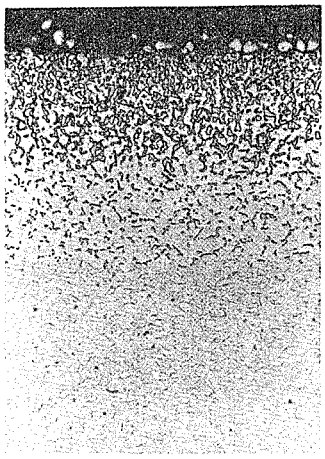

Seventy-four parts by weight of copper, 25 parts by weight of nickel and one part by weight of silicon were melted to form a copper alloy consisting of 71.6% of copper, 26.3% of nickel and 2.1% of silicon. This alloy was rolled into a 50 mm square sheet having a thickness of 1 mm. This specimen was immersed for four hours in a molten salt bath composed of 70 parts by weight of borax, and 30 parts by weight of boron carbide powder having a particle diameter of 79 to 149 microns, and having a temperature of 900° C., whereby a boride dispersion copper alloy was obtained. FIG. 2 is a microphotograph showing a cross section of the alloy obtained. As is obvious from FIG. 2, the alloy had a surface portion having a thickness of 0.08 mm, and containing about 30% by volume of nickel boride having a particle diameter of 0.2 to 4 microns.

EMBODIMENT 4

Figure 3:
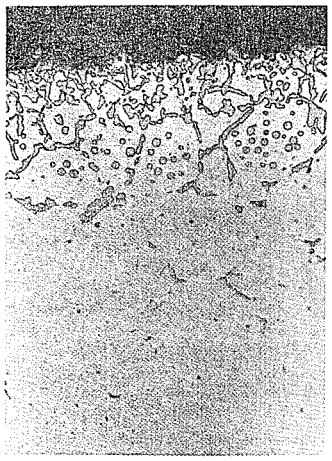

Seventy-four parts by weight of copper, 25 parts by weight of nickel and one part by weight of titanium were melted to form a copper alloy consisting of 72.2% of copper, 26.5% of nickel and 1.3% of titanium. This alloy was rolled into a 50 mm square specimen having a thickness of 1 mm. The boriding treatment of EMBODIMENT 3 was repeated for the specimen, whereby a boride dispersion copper alloy was obtained. FIG. 3 is a microphotograph showing a cross section of the alloy obtained. The alloy had a surface portion having a thickness of 0.075 mm, and containing about 30% by volume of nickel boride having a particle diameter of about 1 to 12 microns.

EMBODIMENT 5

A nickel layer having a thickness of about 20 microns was electroplated on the surface of a 50 mm square pure copper sheet having a thickness of 1 mm. The copper sheet was heated at 900° C. for two hours in an atmosphere having a vacuum of $10^{-3}$ torr, whereby nickel was diffused in copper to form a nickel-copper alloy in the surface portion of the sheet. The molten salt bath treatment of EMBODIMENT 1 was repeated for the copper sheet to yield a boride dispersion copper alloy. The alloy had a surface portion having a thickness of 0.08 mm, and containing 60% by volume of nickel boride having a particle diameter of 5 to 30 microns.

EMBODIMENT 6

Ninety parts by weight of copper and 10 parts by weight of manganese were melted to form a manganese-copper alloy consisting of 88.6% of copper and 11.4% of manganese. A rod-shaped specimen having a diameter of 6 mm and a length of 30 mm was prepared from the alloy. The specimen was buried in a powder mixture composed of 90 parts by weight of ferroboron powder containing 20% by weight of boron and having a particle diameter of about 60 to 149 microns, and 10 parts by weight of potassium borofluoride powder having a particle diameter of about 90 microns, and heated at 800° C. for 16 hours, whereby a boride dispersion copper alloy was obtained. The alloy had a surface portion having a thickness of about 0.07 mm, and in which manganese boride having a particle diameter of 5 to 50 microns was dispersed.

EMBODIMENT 7

Figure 4:
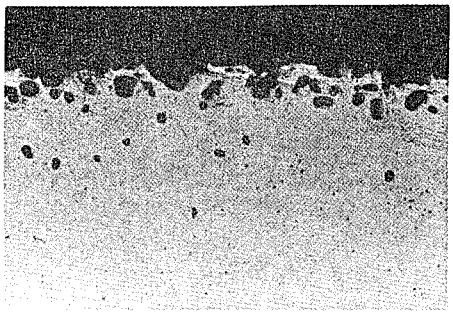

Ninety-five parts by weight of copper and five parts by weight of silicon were melted to form a silicon-copper alloy consisting of 89.4% of copper and 10.6% of silicon. In all other respects, the procedures of EMBODIMENT 6 were repeated for making a boride dispersion copper alloy. FIG. 4 is a microphotograph showing a cross section of the alloy obtained. As is obvious from FIG. 4, the alloy had a surface portion having a thickness of about 0.03 mm, and in which silicon boride having a relatively large particle diameter of 10 to 20 microns was dispersed.

Although the invention has been described with reference to the several embodiments thereof, it is to be understood that modifications or variations may be easily made by anybody of ordinary skill in the art without departing from the scope of this invention which is defined by the appended claims.

What is claimed is:

1. A process for manufacturing a boride dispersed copper alloy, which comprises:
   preparing a metallic material having a surface portion comprising a copper alloy containing at least one metal selected from the group consisting of beryllium, gallium, manganese, nickel, palladium, silicon and vanadium, and copper or an alloy thereof; and
   diffusing boron into said metallic material to form in said surface portion thereof fine particles of a boride of at least one metal selected from the group consisting of beryllium, gallium, manganese, nickel, palladium, silicon and vanadium.
2. A process according to claim 1, wherein
   said metallic material is prepared by coating said at least one metal selected from the group consisting of beryllium, gallium, manganese, nickel, palladium, silicon and vanadium on the surface of copper or an alloy thereof, and heating said coated metal to diffuse the same into said surface portion.
3. A process according to claim 1, wherein
   said surface portion of said metallic material has a depth of from 0.01 to 1 mm.
4. A process according to claim 3, wherein
   said surface portion of said metallic material has a depth of from 0.03 to 0.2 mm.
5. A process according to claim 1, wherein
   said surface portion of said metallic material comprises 5 to 75 atom % of said at least one metal.
6. A process according to claim 1, wherein
   said surface portion of said metallic material during the preparing step further comprises at least one of manganese, titanium, silicon and chromium, thereby promoting the formation of fine boride particles during the diffusing step.
7. A process according to claim 6, wherein
   said at least one of manganese, titanium, silicon and chromium is incorporated in the range of 0.1 to 3 atom %.
8. A process according to claim 1, wherein
   said boride has an average particle diameter of 0.1 to 20 microns.
9. A process according to claim 1, wherein
   said boride occupies about 5 to 80% by volume of said surface portion.
10. A process according to claim 1, wherein
   said boron is diffused by one method selected from the group consisting of a molten salt method, a powder method and a physical vapor deposition method.
11. A process according to claim 1, wherein
   nickel and copper are melted to prepare said metallic material having the surface portion of a copper-nickel alloy, and said metallic material is immersed in a molten salt bath containing boron to form fine nickel boride particles uniformly dispersed in said surface portion.
12. A process according to claim 6, wherein
   nickel, silicon and copper are melted to prepare said metallic material having the surface portion of a copper-nickel-silicon alloy, and said metallic material is immersed in a molten salt bath containing boron to form fine nickel boride particles uniformly dispersed in said surface portion.
13. A process according to claim 6, wherein
   nickel, titanium and copper are melted to prepare said metallic material having the surface portion of a copper-nickel-titanium alloy, and said metallic material is immersed in a molten salt bath containing boron to form fine nickel boride particles uniformly dispersed in said surface portion.

14. A process according to claim 2, wherein a nickel layer is electroplated on pure copper and heated to prepare said metallic material having the surface portion of a copper-nickel alloy, and said metallic material is immersed in a molten salt bath containing boron to form fine nickel boride particles uniformly dispersed in said surface portion.

15. A process according to claim 1, wherein manganese and copper are melted to prepare said metallic material having the surface portion of a copper-manganese alloy, and said metallic material is buried and heated in a powder mixture containing boron to form fine manganese boride uniformly dispersed in said surface portion.

16. A process according to claim 1, wherein silicon and copper are melted to prepare said metallic material having the surface portion of a copper-silicon alloy, and said metallic material is buried and heated in a powder mixture containing boron to form fine silicon boride uniformly dispersed in said surface portion.

* * * * *